United States Patent [19]

Star et al.

[11] Patent Number: 4,733,607

[45] Date of Patent: Mar. 29, 1988

[54] FOOD PROCESSING MACHINE

[76] Inventors: Leonard J. Star, P.O. Box 90, Dunkirk, N.Y. 14048; Jesse J. Tapscott, 3219 Broken Twig, Santa Rosa, Calif.

[21] Appl. No.: 54,618

[22] Filed: May 27, 1987

Related U.S. Application Data

[63] Continuation-in-part of Ser. No. 784,956, Oct. 7, 1985, abandoned.

[51] Int. Cl.[4] ..... B01F 7/08

[52] U.S. Cl. ..... 99/348; 62/343; 99/483; 366/81; 366/85; 366/149; 366/319; 366/320

[58] Field of Search ..... 366/144, 149, 81, 84–86, 366/309–313, 319, 320; 62/342, 343; 99/348, 483, 452, 453, 455

[56] References Cited

U.S. PATENT DOCUMENTS

| | | | |
|---|---|---|---|
| 2,027,185 | 1/1936 | Loomis . | |
| 2,526,367 | 10/1950 | Kaltenbach et al. . | |
| 2,538,716 | 1/1951 | Wakeman | 366/309 |
| 2,746,730 | 5/1956 | Swenson et al. | 62/343 |
| 3,188,677 | 6/1965 | Jamison, Jr. . | |
| 3,641,783 | 2/1972 | Werner | 62/343 |
| 3,752,057 | 8/1973 | Groen, Jr. | 99/348 |
| 4,154,372 | 5/1979 | Ricciardi | 366/320 |
| 4,274,751 | 6/1981 | Rector et al. | 366/320 X |

*Primary Examiner*—Timothy F. Simone
*Attorney, Agent, or Firm*—Phillips, Moore, Lempio & Finley

[57] ABSTRACT

A mixer for food products and the like in commercial quantities comprises a horizontally elongated body with a trough bottom in which rotates one or more horizontal drive shafts carrying an agitator in the form of a helical ribbon or worm of a radius matching that of the trough bottom. The ribbon supports a number of scraper units on it, each scraper unit including a scraper body having a broad face facing toward the trough bottom, the broad face terminating in two opposed relatively sharp edges. The scraper bodies are mounted for rocking movement so that the leading edge will be forced into scraping engagement with the trough bottom and will remain in engagement with the trough bottom even though the trough is wavy or uneven. Either of the edges of the scraper body can be the leading edge, depending on the direction of rotation of the agitator drive shaft. The vessel preferably is formed with a pair of arcuate troughs which have a circumferential arc of 180° from their upper edges and substantially flat lower edge extensions tangent to said trough. Those extensions meet in a horizontal line which in profile is the apex of a cusp. The upper edges of the troughs define the mixer hatch which has a width less than the greater inside width of the vessel. The mixer thus has a useful volume considerably greater than a conventional mixer and minimizes or eliminates throw out of mixture particles against walls not reached by its scrapers.

12 Claims, 8 Drawing Figures

FOOD PROCESSING MACHINE

This is a continuation-in-part of Ser. No. 784,956, filed Oct. 7, 1985, ABND.

This invention relates to apparatus for commercially mixing and blending plastic and liquid substances under controlled conditions of heating and cooling. It is more particularly concerned with, but not limited to, apparatus for processing food products and will be described hereinafter with reference to such products.

BACKGROUND OF THE INVENTION

Food products and the like are commonly mixed and blended under commercial conditions in vessels which are more or less cylindrical in horizontal or vertical section and provided with a power driven agitator or agitators which rotate therein. The vessels are heated or cooled as desired. The contents are often of a nature which sticks to the interior vessel walls. While the agitators scrape off such materials to a considerable extent, the vessel walls are not always truly circular and of course there must be some clearance between agitator and wall. Various types of scrapers have been suggested but none has achieved any substantial commercial acceptance because of the tendency to leave material on the walls, which if heated will cause the material to overcook and even burn thereon. Overcooking and burning can have a very deleterious effect on product quality, especially flavor and odor. It also lowers the efficiency of the cooking operation and is often very difficult to remove.

A type of vessel suitable for large batches is horizontally elongated and has a pair of agitators which rotate on parallel horizontal shafts. The bottom of the vessel in vertical section is a pair of circular arcuate troughs meeting mid-way between the agitators in a cusp. The troughs have radii slightly greater than the radius of the agitators. Those trough walls merge at the sides of the vessel into vertical walls which extend to the top of the vessel. When the vessel walls are heated for hot mixing and blending, no scraper affixed to the agitators can scrape the vertical walls of the vessel and any material which is deposited on any heated vertical portion of the walls will usually burn there with all of the attendant disadvantages earlier described. Vessels of the type mentioned therefore are seldom used to the full extent of their capacity.

SUMMARY OF THE INVENTION

The vessel of the present invention is a horizontal vessel somewhat similar to that described above. However, the agitators carry a number of scraper units each having a scraper body with a broad face oriented toward the vessel wall, the face terminating at two opposed and relatively sharp edges. The scraper bodies are self-adjusting in either direction of rotation of the agitators and are attached to the agitators for rocking movement so that whichever edge of the scraper body is leading will be maintained in scraping engagement with the arcuate vessel wall in spite of irregularities in the curvature of the wall. Because the scraper bodies follow the wall curvature, the curved wall portions can be extended up and over the agitators by 45° or so, considerably increasing the useful heat transfer surface in contact with product. In the present vessel there is no danger of burning material on the arcuate vessel walls and little likelihood of mix material being thrown out on the wall portions thereabove.

DESCRIPTION OF PREFERRED EMBODIMENTS

Figure 1:
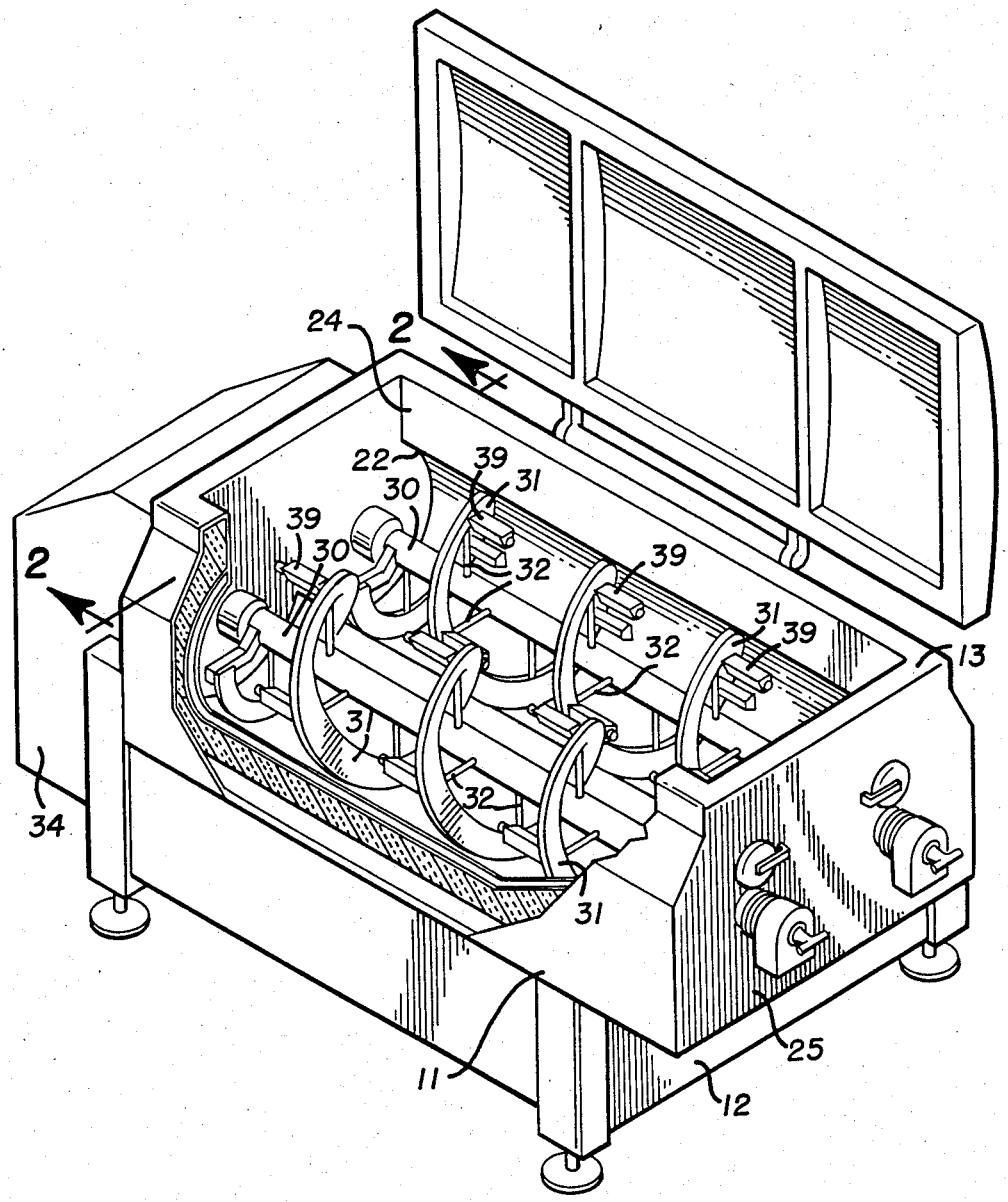
FIG. 1 is a partially cut away isometric view of the apparatus of the present invention.
Figure 2:
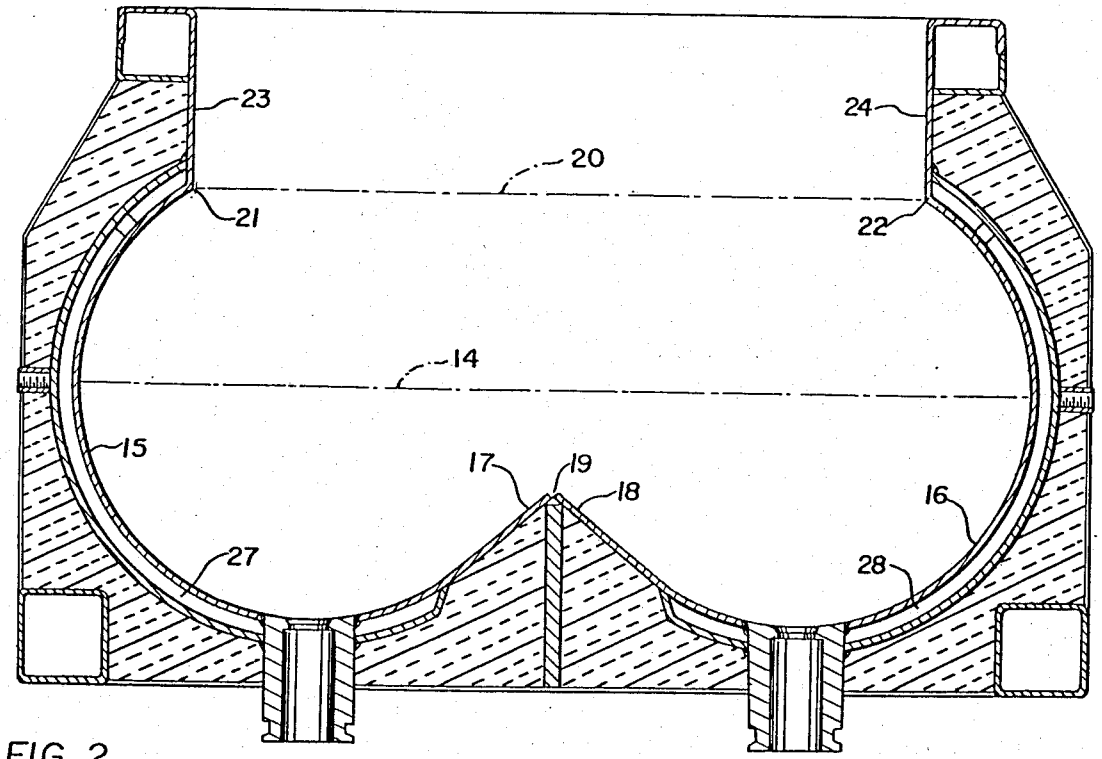
FIG. 2 is a vertical section through the vessel of the apparatus taken on the plane 2—2 of FIG. 1. The agitators have been removed for clarity.

The mixer shown in FIG. 1 comprises a horizontally elongated body 11 mounted on a supporting base 12. Body 11 has a top hatch or opening 13 extending over its length but not its entire width and closed during operation by a hinged cover. The body, a cross-section of which is shown in FIG. 2, has the form of a pair of horizontal right and left semi-cylindrical troughs 15 and 16 with smooth inside faces. The lower extensions 17 and 18 respectively of those facaes join in a horizontal line so that in profile their faces form a cusp 19. Cusp 19 above-mentioned is below the plane 14 containing the longitudinal axes of troughs 15 and 16 by something less than 30°, measured circumferentially. The upper edges 21 and 22 of troughs 15 and 16 are in a plane 20 parallel to, but above the plane 14 on an arc of about 45° or so relative to said longitudinal axes. Above the plane 20, the walls 23 and 24 of the mixer body are vertical. Planes 14 and 20 are shown in chain lines in FIG. 2. Plane 14 is wider than plane 20 within body 11. The ends 25 of the mixer body, one of which is shown in FIG. 1, are substantially flat. A steam jacket 27 surrounds trough 15, but not extension 17 and a like steam jacket 28 surrounds trough 16, but not extension 18 of our vessel. Both jackets extend up to plane 20.

Parallel shafts 30 are journaled in the ends 25 of the mixer body co-axial with the axes of troughs 15 and 16 respectively. Each shaft supports an agitator 31 in the form of a helical ribbon or worm twisted around it and extending over its length spaced from the shaft by spokes 32. The radius of the ribbon is slightly less than that of troughs 15 and 16. The rotation and drive mechanism for shafts 30 is at one end of the mixer within end enclosure 34.

The lower extensions 17 and 18 mentioned above are flat to cusp 19 from lines spaced 180° circumferentially from edges 21 and 22 respectively and are tangent to the inner surfaces of troughs 15 and 16 at those lines so that the shafts 30 and helical agitator ribbons 31 can be easily removed from troughs 15 and 16. The vessel so constructed has a considerably greater useful volume than vessels of conventional construction, whereby it can process more material in the same of less time.

Figure 3:
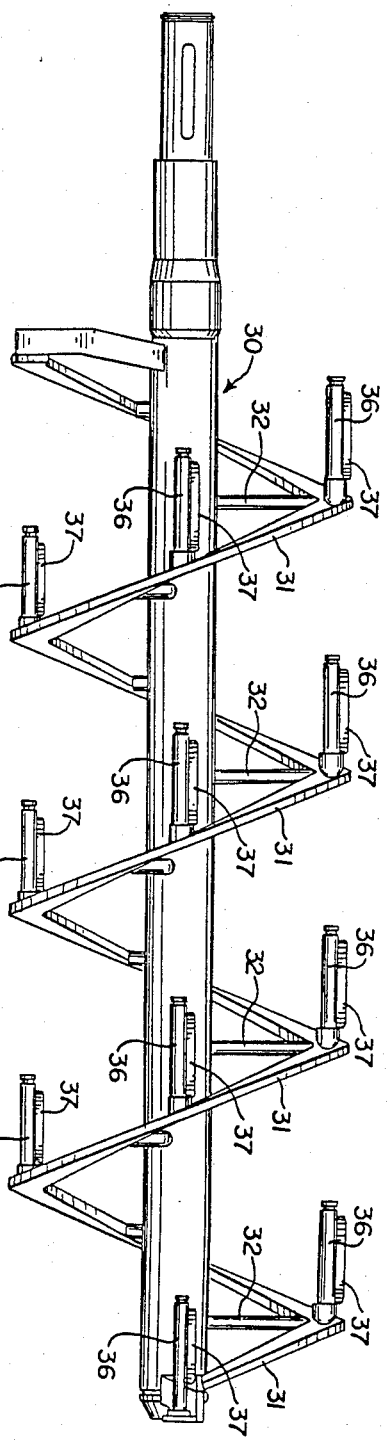
FIG. 3 is a side elevation of an agitator without its scraper units.
Figure 4:
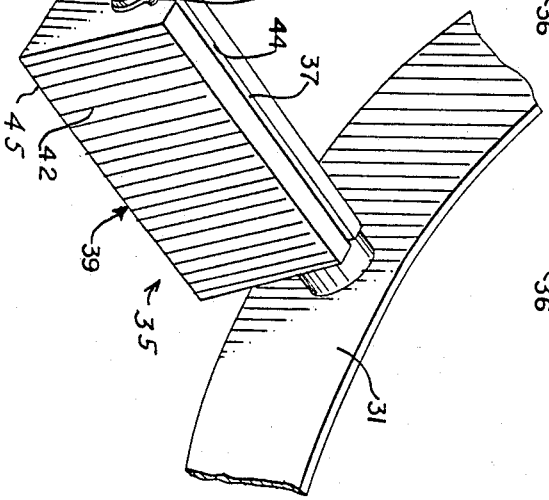
FIG. 4 is a detail showing a scraper unit of the invention mounted on a scraper shaft which is fixed to an agitator.

FIGS. 1, 3 and 4 illustrate one form of the scraper unit 35 of the present invention.

Along the length of ribbons 31 and around shafts 30 are positioned pivot shafts 36 uniformly spaced from each other, as shown in FIG. 3. Pivot shafts 36 are affixed with their axes parallel to the axis of shafts 30. Each pivot shaft has a longitudinal key 37 extending over its length which is fixed and projects beyond the surface of shaft 36. As shown in FIG. 4, on each shaft 36 is mounted a scraper body 39 which is a block of plastic material having a length slightly less than the length of shaft 36. In cross-section scraper body 39 is a trapezoid having a broad face 40, a narrow face 41 parallel thereto and a pair of faces 42 connecting faces 40 and 41 but inclined to both. Scraper body 39 has a center bore 43 extending longitudinally therethrough large enough to accept shaft 36. In narrow face 41, a longitudinal channel 44 is cut through to center bore 43, the channel being sufficiently wider than key 37 that scraper body 39 can rock through an angle of about 15°. The broad face 40 terminates at two opposed and relatively sharp edges 45.

In the operation of the apparatus the substances to be mixed are loaded into body 11 through its hatch 13. If the charge is to be mixed hot, steam is admitted to steam jackets 27 and 28 from a source not shown. Shafts 30 are caused to rotate by starting the rotating mechanism in enclosure 34.

It will be observed in FIG. 1 that ribbons 31 on one shaft 30 is offset longitudinally from the ribbon on the other shaft and that the scrapers 39 mounted on one ribbon 31 all face toward the same end of the vessel 11 while the scrapers 39 mounted on the other ribbon 31 all face toward the opposite end of body 11. Scrapers are on the noram trailing side of ribbons so that when plowing through heavy viscous product, the mixing efficiency of the ribbons is not lessened by the scrapers.

Shafts 30 are counter-rotated. The worms or ribbons 31 carried by the shafts blend and mix the elements of the charge and cause it to move both circumferentially and axially with respect to troughs 15 and 16 of body 11. That motion tends to prevent sticking and burning of the charge on the faces of troughs 15 and 16 to the extend that the edges of ribbons 31 contact those faces throughout their travel. Ribbons 31 however must be rigid to accomplish their mixing function and the inside surfaces of troughs 15 and 16 cannot be maintained absolutely true. The scraper bodies 39 described hereinabove rock sufficiently on their pivot shafts 36 to allow one or the other of their sharp edges 45, whichever is leading depending upon the direction of rotation of ribbons 31, to scrape against the surface of troughs 15 and 16. Furthermore, the viscosity of the substances being mixed causes the mix to press against the leading inclined face 42 of scraper body 39 as that scraper body is moved through the mix, wedging the leading edge 45 against the surface of troughs 15 and 16 so as to scrape it clean even though the trough surfaces are wavy or otherwise uneven or untrue. The self-adjusting rocking and wedging action occurs during rotation of ribbons 31 in either direction.

As can be seen, the pivot shaft mounting arrangement and the inclined faces 42 on the scraper bodies cooperate together and constitute attachment and forcing means for attaching the scraper bodies to the agitator ribbon 31 for rocking motion of the scraper body about an axis parallel to the rotatable shaft 30 and for forcing the leading edge 45 of the scraper body 39 into scraping engagement with the arcuate trough upon rotation of the shaft in either direction.

The self-adjusting action above-mentioned occurs not only over the areas of troughs 15 and 16 below the plane 14 but also in those areas of the troughs above that plane up to plane 20, thus providing increased useful mixer capacity. The overhang of those troughs up to plane 20 virtually eliminates mixture being thrown up against vertical walls 23 and 24 and being burned there.

FIGS. 4–8 illustrate another form of scraper unit 48 of the present invention. Again a plastic scraper body 49 is provided, with a trapezoidal cross-section, and having a broad face 50, a narrow face 51 and a pair of inclined faces 52 connecting faces 50 and 51 but inclined to both. The broad face 50 terminates at two opposed and relatively sharp edges 55. The broad face 50 is substantially normal to the radius of the agitator ribbon 31 and faces away from the rotatable shaft 30. One of the two edges 55 will be the leading edge, and the other will be the trailing edge, depending upon the direction of rotation of the rotatable shaft 30 and ribbon 31.

In this form of the invention, elongated leaf spring 56 constitutes an attachment and forcing means for attaching the scraper body 49 to the agitator ribbon 31 for rocking motion of the scraper body about an axis parallel to the rotatable shaft 30 and for forcing the leading edge 55 of the scraper body 49 into scraping engagement with the arcuate trough upon rotation of the shaft 30 in either direction.

Figure 5:
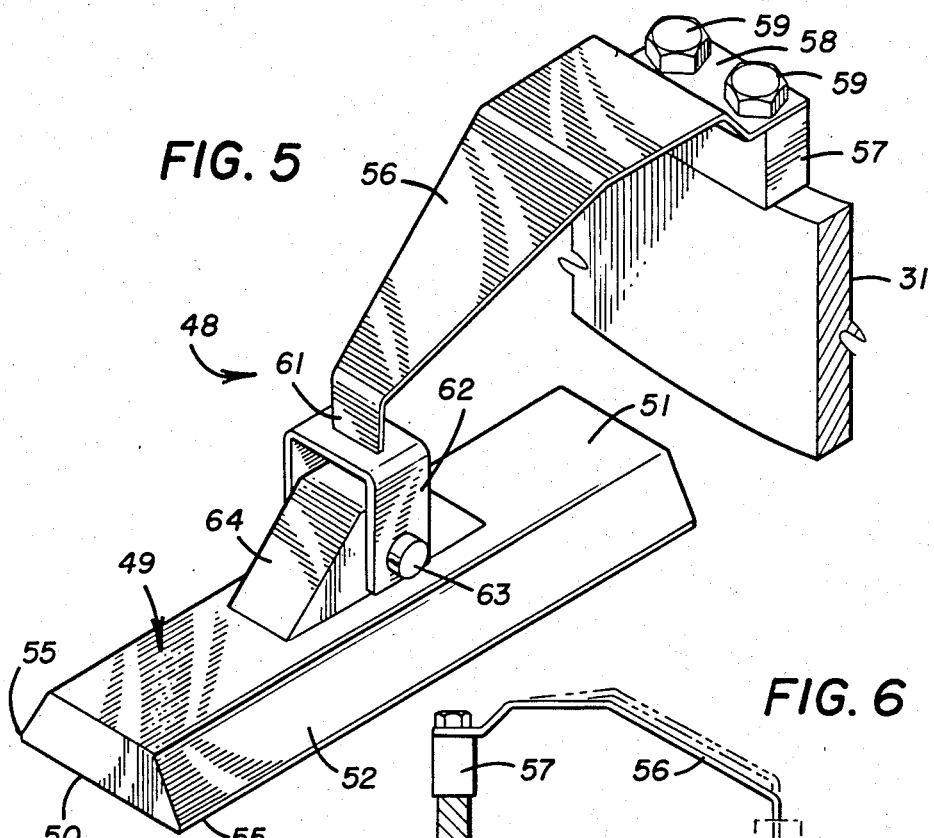
FIG. 5 is a isometric view of another form of a scraper unit of the invention mounted on an agitator.

As best seen in FIG. 5, a block 57 is fixed to agitator ribbon 31 and one end 58 of a spring steel leaf spring 56 is secured to block 57 by bolts 59. The other end 61 of leaf spring 56 is fixed to clevis 62. Pivot pin 63 passes through clevis 62 and head 64 of scraper body 49.

Figure 6:
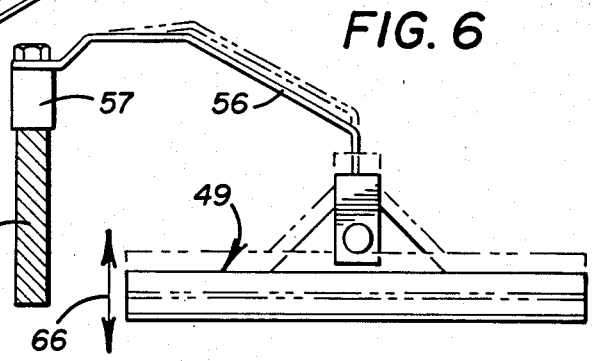
FIG. 6 is a side view of the scraper of FIG. 5, illustrating one manner of movement of the scraper body.

As can be seen from FIG. 6, leaf spring 56 mounts the scraper body 49 relative to agitator ribbon 31 so that the scraper body can move in a direction as indicated by arrow 66, i.e., towards and away from the rotatable shaft 30 on which ribbon 31 is mounted, between the positions shown in FIG. 6. The leaf spring is pretensioned to apply constant force of the scraper body against the arcuate trough wall. The amount of pretension provided is a balance between applying enough force against the trough wall for adequate cleaning and yet holding to a minimum the "over travel" of the scraper body when it has been moved out of engagement with the trough wall upon rotation of shaft 30 and ribbon 31.

Figure 7:
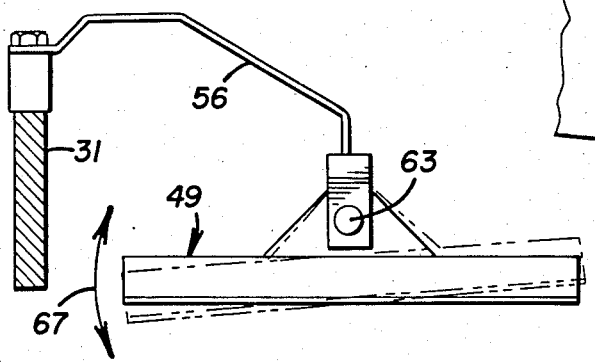
FIG. 7 is a side view of the scraper of FIG. 5, illustrating one manner of rocking movement of the scraper body.

As illustrated in FIG. 7, the pivot pin 63, which is aligned with the direction of movement of the scraper body as the agitator 31 rotates, permits the scraper body to rock about the axis of pivot pin 63, as indicated by arrow 67, thus ensuring that the scraper body adjusts to any irregularities in the trough wall.

Figure 8:
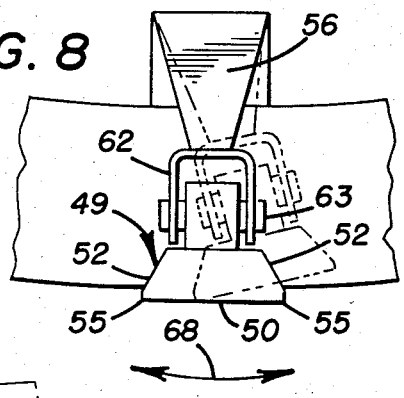
FIG. 8 is an end view of the scraper of FIG. 5, illustrating another manner of rocking movement of the scraper body.

As best seen in FIG. 8, the elongated leaf spring 56 can twist about its length such that the scraper body 49 may rock about an axis normal to ribbon 31, as indicated by arrow 68 so that the leading edge 55 of the scraper body is forced into engagement with the trough wall while the trailing edge 55 moves away from the wall. The scraper body 49 will rock in either direction, depending on the direction of movement of the scraper unit relative to the trough wall.

The illustrated design of the leaf spring results in the scraper body being much more rigid in the direction of travel than it is in torsion. As the scraper body makes contact with hard, sticky burn-on (the industry term for hard overcooked crust on the heat exchange surface), the combination of the flat rectangular cross-section of leaf spring 56, the twisting capability thereof and the normal force of the spring causes the scraper body to rock and dig in to remove the burn-on. The harder the crust, the more the rocking and the greater the force applied to scrape the burn-on off.

The substances being mixed will press against the leading inclined face 52 of a scraper body, as the agitator rotates in the mix, and such pressure will assist in rocking the scraper body so that its leading edge only engages the trough wall.

The foregoing description of preferred embodiments has been presented for purposes of illustration and description. It is not intended to be exhaustive or to limit the invention to the precise forms described, and obviously many modifications and variations are possible in light of the above teaching. The embodiments were chosen and described in order to best explain the principles of the invention and its practical application to thereby enable others in the art to best utilize the invention in various embodiments and with various modifications as are suited to the particular use contemplated. It is intended that the scope of the invention be defined by the claims appended hereto.

We claim:

1. In a batch mixer for food products and the like having a horizontally elongated body and at least one ribbon agitator therein affixed to a rotatable shaft extending lengthwise of said body, said body having at least one arcuate trough conforming to said ribbon agitator over a portion of its length, the improvement comprising:

a plurality of scrapers each having a scraper body with a broad face substantially normal to the radius of said ribbon and facing away from said rotatable shaft, said broad face terminating at two opposed and relatively sharp edges along the scraper body generally parallel to the rotatable shaft, one of which is the leading edge and the other of which is the trailing edge depending on the direction of rotation of the rotatable shaft, attachment and forcing means for attaching each of said scraping bodies to the ribbon for rocking motion of the scraper body about an axis parallel to said rotatable shaft and for forcing the leading edge of the scraper body into scraping engagement with the arcuate trough upon rotation of said shaft in either direction.

2. The mixer of claim 1 in which said attachment and forcing means includes:

pivot shafts affixed to said ribbon at intervals along its length, said pivot shafts having their axes parallel to the rotatable shaft, said scraper bodies being trapezoids in section normal to the pivot shafts and having a narrow face parallel to said broad face, said scraper bodies being mounted on said pivot shafts intermediate their broad and narrow faces so as to rock about a position maintaining the scraper bodies with broad faces substantially normal to the radius of the ribbon, said scraper bodies each having inclined faces extending from the two edges of the broad face towards the narrow face, whereby rotation of the agitator in either direction in the presence of product to be mixed causes the product to act on the leading inclined face of a scraper body causing the leading edge of that scraper body to be forced against the arcuate trough.

3. The mixer of claim 2 in which said scraper bodies are mounted on said pivot shafts so as to rock thereon through an angle of about 15°.

4. The mixer of claim 1 in which said attachment and forcing means includes an elongated leaf spring for each scraper unit, each leaf spring being attached at one end thereof to said ribbon and being attached at its other end to a scraper body, said leaf spring being pretensioned to bias the scraper body against the arcuate trough when adjacent thereto, said leaf spring being twistable about its length such that the scraper body may rock to force the leading edge thereof into engagement with the arcuate trough while the trailing edge thereof moves away from the arcuate trough.

5. The mixer of claim 4 in which said other end of said leaf spring is connected to said scraper body such that the scraper body may rock about an axis which is aligned with the direction of movement of the scraper body as the rotatable screw rotates.

6. The mixer of claim 4 in which said scraper body is trapezoidal in section and has a narrow face parallel to said broad face and inclined faces from the edges of the braod face towards the narrow face.

7. The mixer of claim 1 including two arcuate troughs each having a circumferential arc of 180° from its upper edge and a substantially flat lower edge extension tangent to said trough, said extensions meeting in a line to form a cusp.

8. The mixer of claim 7 including a hatch opening in the upper surface of said body, said cusp lying below the plane of the axes of said troughs and said upper edges lying in a plane above the plane of said axes, said upper edges defining the width of said hatch opening.

9. The mixer of claim 8 in which said upper edges of said troughs are joined by vertical walls to a hatch.

10. The mixer of claim 8 in which the width of said hatch opening is less than the width of said plane within said body containing the axes of said troughs.

11. The mixer of claim 8 comprising first and second ribbon mixing screws each positioned to rotate in its own said arcuate trough, all the scrapers attached to said first ribbon mixing screw being faced toward the same end of said elongated body and all the scrapers attached to said second ribbon mixing screw being faced toward the other end of said elongated body.

12. The mixer of claim 7 including heating jackets surrounding said circumferential arc portions of said troughs but not said lower edge extensions.

* * * * *